US007361261B2

(12) United States Patent
Switzer et al.

(10) Patent No.: US 7,361,261 B2
(45) Date of Patent: Apr. 22, 2008

(54) METHOD OF PREPARING A CHIRAL SUBSTRATE SURFACE BY ELECTRODEPOSITION

(75) Inventors: Jay A. Switzer, Rolla, MO (US); Hiten M. Kothari, Rolla, MO (US); Shuji Nakanishi, Rolla, MO (US); Eric W. Bohannan, Rolla, MO (US)

(73) Assignee: The Curators of the University of Missouri, Columbia, MO (US)

( * ) Notice: Subject to any disclaimer, the term of this patent is extended or adjusted under 35 U.S.C. 154(b) by 260 days.

(21) Appl. No.: 10/884,868

(22) Filed: Jul. 2, 2004

(65) Prior Publication Data

US 2005/0045489 A1 Mar. 3, 2005

Related U.S. Application Data

(60) Provisional application No. 60/488,247, filed on Jul. 18, 2003.

(51) Int. Cl.
*C25D 3/02* (2006.01)
*C25D 9/06* (2006.01)

(52) U.S. Cl. ..... 205/206; 205/333

(58) Field of Classification Search ..... 205/333, 205/206

See application file for complete search history.

(56) References Cited

U.S. PATENT DOCUMENTS

2002/0014415 A1* 2/2002 Nakayama et al. ..... 205/317

FOREIGN PATENT DOCUMENTS

WO WO-2005063386 A2 7/2005
WO WO-2005063386 A3 7/2005

OTHER PUBLICATIONS

Julius Grant, Hackh's Chemical Dictionary, fourth edition, McGraw-Hill Book Company, New York, 1969, pp. 662.*
Golden et al, "Electrochemical Deposition of Copper(I) Oxide Films", Chem. Mater. 1996, 8, 2499-2504.*
Ahmadi, A. , et al., "Surface Reactivity at "Chiral" Platinum Surfaces", *Langmuir*, 15, XP002331326, published on web Mar. 5, 1999, (1999), 2420-2424.
Attard, G. , et al., "Temperature Effects in the Enantiomeric Electro-Oxidation of D- and L-glucose on pt{643}s", *Journal of Physical Chemistry B*, 103, XP002331327, (1999).

(Continued)

*Primary Examiner*—Susy Tsang-Foster
*Assistant Examiner*—William T. Leader
(74) *Attorney, Agent, or Firm*—Schwegman, Lundberg and Woessner, P.A.

(57) ABSTRACT

A solid substrate comprising a surface comprising an achiral array of atoms having thereupon a chiral metal oxide surface. The chiral metal oxide surface is prepared by electrodeposition of a chiral metal oxide array from a solution of a chiral salt of the metal. In one embodiment, chiral CuO is grown on achiral Au(001) by epitaxial electrodeposition. The handedness of the film is determined by the specific enantiomer of tartrate ion in the deposition solution. (R,R)-tartrate produces an S—CuO($1\bar{1}\bar{1}$) film, while (S,S)-tartrate produces an R—CuO($\bar{1}1\,1$) film. These chiral CuO films are enantiospecific for the electrochemical oxidation of(R,R) and (S,S)-tartrate.

7 Claims, 8 Drawing Sheets
(2 of 8 Drawing Sheet(s) Filed in Color)

OTHER PUBLICATIONS

Bohannan, E. W., et al., "Epitaxial Electrodeposition of Copper(I) Oxide on Single-Crystal Gold(100)", *Chemistry of Materials*, 11(9), XP000859960, (Sep. 1999), 2289-2291.

Kothari, H. M., et al., "Enantiospecific Electrodeposition of Chiral CuO Films from Copper(II) Complexes", *Chemistry of Materials*, 16, XP002331329, (2004), 4232-4244.

McFadden, Christopher F., et al., "Adsorption of Chiral Alcohols on "Chiral" Metal Surfaces", *Langmuir, American Chemical Soc.*, 12(10), (1996), 2483-2487.

Poizot, P. , et al., "An Electrochemical Method for CuO Thin Film Deposition From Aqueous Solution", *Electrochemical and Solid-State Letter*, 6(2), XP002331324, (2003), C21-C25.

Sholl, David S., "Adsorption of Chiral Hydrocarbons on Chiral Platinum Surfaces", *Langmuir, American Chemical Soc.*, 14(4), XP002116789, (1997), 862-867.

Switzer, J. A., et al., "Enantiospecific Electrodeposition of a Chiral Catalyst", *Nature*, 425, XP002331328, (Oct. 2, 2003), 490-493.

Switzer, J. A., et al., "Epitaxial Electrodeposition of a Crystalline Oxide onto Single-Crystalline Silicon", *J. Phys. Chem B*, 106, American Chemical Society, XP002331325, (2002), 12369-12372.

Kothari, H. M., et al., "Epitaxial Electrodeposition of Pb-TI-O Superlattices on Single-Crystal Au(100)", *Chemistry of Materials*, 14, (2002),2750-2756.

Liu, R. , et al., "Epitaxial Electrodeposition of Zinc Oxide Nanopillars on Single-Crystal Gold", *Chemistry of Materials*, 13(2), (2001),508-512.

Sorenson, T. A., et al., "Epitaxial Electrodeposition of Fe3O4 Thin Films on the Low-Index Planes of Gold", *Journal of the American Chemical Society*, 124(25), (2002),7604-7609.

Switzer, J. A., et al., "Electrodeposited ceramic single crystals", *Science*, 284(5412), (1999),293-6.

Switzer, J. A., et al., "Thermodynamic to Kinetic Transition in Epitaxial Electrodeposition", *Journal of Physical Chemistry B*, 106(16), (2002),4027-4031.

"International Application No. PCT/US2004/021966 International Preliminary Report on Patentability mailed Jun. 20, 2005", 10.

"International Application No. PCT/US2004/021966 International Search Report and Written Opinion mailed Jun. 22, 2005", 16.

* cited by examiner

METHOD OF PREPARING A CHIRAL SUBSTRATE SURFACE BY ELECTRODEPOSITION

RELATED APPLICATION

This application is a non-provisional application claiming benefit under 35 U.S.C. § 119(e) of U.S. Provisional Application No. 60/488,247, entitled "Enantiospecific catalysts prepared by chiral deposition," filed Jul. 18, 2003, which is incorporated herein by reference.

U.S. GOVERNMENT RIGHTS

This invention was made with the support of the U.S. Government under National Science Foundation Grants DMR-0071365, DMR-0076338, and CHE-024324. The Government has certain rights in the invention.

BACKGROUND OF THE INVENTION

Chirality is ubiquitous in Nature. One enantiomer of a molecule is often physiologically active, while the other enantiomer may be either inactive or toxic. For example, S-ibuprofen is as much as 100 times more active than R-ibuprofen. R-thalidomide is a sedative, but S-thalidomide causes birth defects. Worldwide sales of chiral drugs in single enantiomeric dosage forms reached $133 billion in 2000, growing at an annual rate of 13%. See, S. C. Stinson, Chiral Pharmaceuticals, *Chem. Eng. News,* 79(40), 79 (2001). The industrial synthesis of chiral compounds presently utilizes solution-phase, homogeneous catalysts and enzymes.

There have been elegant experiments directed at the production of enantiospecific heterogeneous catalysts in which achiral surfaces are modified by chiral molecules in order to impart enantiospecificity to the surface. It has been shown, for instance, that tartaric acid adsorbed onto both Cu(110) and Ni(110) produces chiral surfaces. See, e.g., M. O. Lorenzo et al., *Nature* 404 376 (2000) and V. Humblot et al., *J. Amer. Chem. Soc.,* 124, 503 (2002). A. Kuhnle et al., *Nature,* 415, 891 (2002) reported that cysteine adsorbed on Au(110) from a racemic mixture forms molecular pairs which are exclusively homochiral. Y. Izumi et al., *Adv. Catal.,* 32, 215 (1983) reported that Raney Ni modified with (R,R)-tartaric acid can be used to catalyze the hydrogenation of β-ketoesters, producing the R-product with over 90% enantiomeric excess. Switching the enantiomer of the adsorbate switches the product to the S-isomer. One problem with this approach to heterogeneous catalysis is that the adsorption of chiral modifiers needs to be carefully maintained during the synthesis. See, C. LeBlond et al., *J. Amer. Chem. Soc.,* 121, 4920 (1999).

Another approach to the preparation of chiral heterogeneous catalysts is to use high-index surfaces of single crystals. These high-index surfaces are prepared by slicing a low-index single crystal at an angle. The groups of Gellman and Attard have shown that high-index faces of fcc metals can exhibit chirality due to kink sites on the surface. For example, Pt and Au metal crystals with (643) and $(\overline{643})$ faces are enantiomorphs. See, e.g., C. F. McFadden et al., *Langmuir,* 12, 2483 (1996); J. D. Horvath et al., *J. Amer. Chem. Soc.,* 123, 7953 (2001); op. cit., 124, 2384 (2002); A. Ahmadi et al., *Langmuir,* 15, 2420 (1999); G. A. Attard et al., *J. Phys. Chem. B.* 103, 1381 (1991); op. cit., 105, 3158 (2001). D. S. Sholl et al., *J. Phys. Chem. B.* 105, 4771 (2001) have proposed a naming and characterization scheme for these chiral metal surfaces. Only the surface of these materials is chiral, because the fcc metals are highly symmetrical and do not have chiral space groups. The (531) surface of Pt has been shown to be enantioselective for the electrochemical oxidation of 1-glucose by A. Ahmadi et al., *Langmuir,* 15, 2420 (1959). However, there are presently no heterogeneous catalysts that can be used for chiral synthesis on a commercial scale.

Thus, there is a continuing need for enantiospecific heterogeneous catalysts, that are sufficiently stable so that they can be easily separated from the starting materials and products. There is also a need for chiral surfaces that can be used as electrochemical sensors to detect chiral molecules.

SUMMARY OF THE INVENTION

A composition of matter is provided comprising a solid substrate or body having a surface which is chiral (i.e., having handedness). This chiral surface is produced on an achiral substrate surface, preferably by electrodeposition of metal oxide films on the surfaces. The handedness of the resultant surfaces is determined by the chirality of film precursors such as organometallic salts, such as complexes, in the electrodeposition solution.

The chiral surfaces can be used as heterogeneous catalysts for the enantiospecific syntheses of chiral molecules. They can also be used to produce enantiospecific chemical and biological sensors. One application of the invention is envisioned to be the production and analysis of single enantiomer drugs in the pharmaceutical industry. There are presently believed to be no commercially useful heterogeneous catalysts for chiral synthesis. The method of the invention can also be used to produce sensors for chiral molecules such as chemical warfare agents. The present synthetic method is simple and inexpensive, and is widely applicable.

In one embodiment of the invention, chiral CuO is grown on achiral Au(001) by epitaxial electrodeposition. The handedness of the film is determined by the specific enantiomer of tartrate ion in the deposition solution. (R,R)-tartrate produces an S—CuO$(1\ \bar{1}\ \bar{1})$ film, while (S,S)-tartrate produces an R—CuO$(\bar{1}\ 1\ 1)$ film. These chiral CuO films are enantiospecific for the electrochemical oxidation of (R,R) and (S,S)-tartrate.

Therefore, an electrode comprising such a chiral surface can be used to electrochemically oxidize an organic molecule comprising at least one chiral center by oxidizing the organic molecule and an enantiomer thereof with said electrode having a surface of the same chirality as said chiral center under conditions so as to selectively oxidize said organic molecule. The oxidized molecule may be an intermediate or end-product in a synthetic route to a bioactive compound that can then be readily separated from the unoxidized enantiomer(s) thereby accomplishing the resolution or partial resolution of the end-product.

BRIEF DESCRIPTION OF THE FIGURES

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
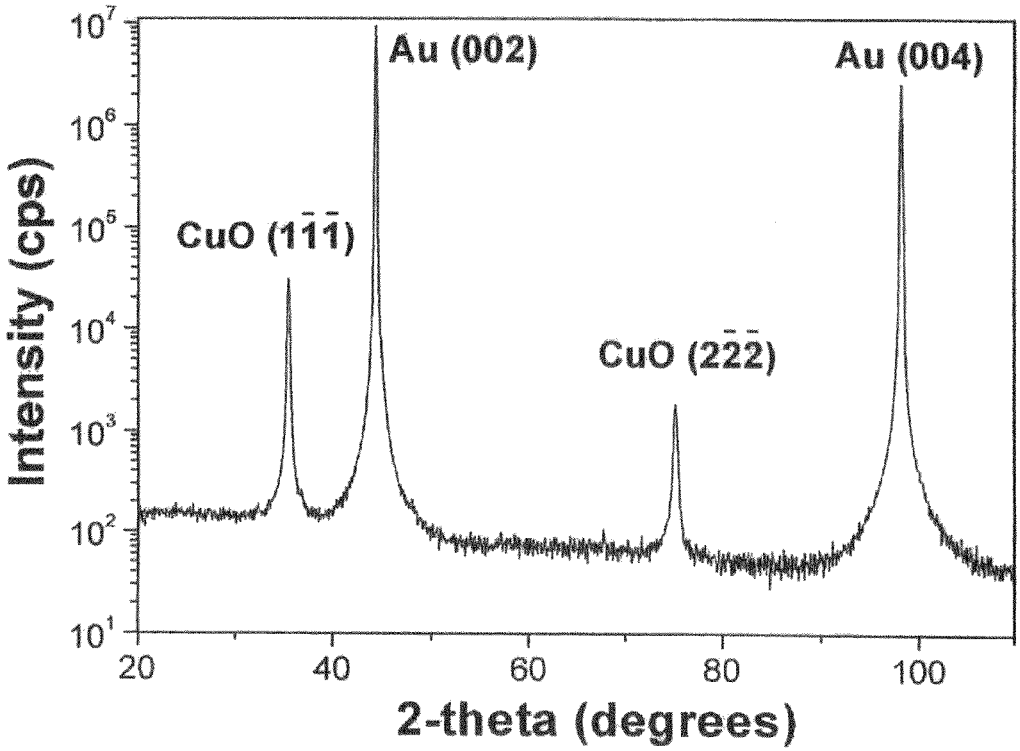
FIG. 1 depicts the Bragg-Brentano (θ-2θ) x-ray diffraction scan probing the out-of-plane orientation of CuO that was electrodeposited from a solution of Cu(II)(S,S-tartrate) onto a single-crystal Au(001) surface. Only the $(1\ \bar{1}\ \bar{1})$ and $(2\bar{2}\bar{2})$ peaks of CuO are observed, indicating that the system has the CuO(1 $\bar{1}$ $\bar{1}$)//Au(001) epitaxial relationship. The x-ray radiation is CuK$\alpha_1$, with a wavelength of 0.1540562 nm.

The present invention provides stable surfaces that can function as enantiospecific heterogeneous catalysts and sensors. These surfaces are formed by the electrodeposition of epitaxial films of low symmetry materials, such as monoclinic CuO, from solution onto high symmetry achiral surfaces such as cubic Au(001) or single crystal Cu(111). As used herein, the term "achiral surface" or "achiral array" includes both ordered achiral surfaces, such as single crystal, textured or polycrystalline surfaces, as well as the surfaces of chiral materials that do not have a center symmetry. In other words, it is not necessary that the metal oxide crystallize in a chiral space group, so long as the surface does not contain a center of symmetry. The chirality of solution precursors such as organic counterions, e.g., salts such as metal amino acid salts or metal salts of chiral chelators, controls the handedness of the electrodeposited film. Useful chelators are disclosed, e.g., in U.S. Pat. Nos. 5,300,279, 4,853,209 and 4,882,142.

Electrodeposition has been used to deposit epitaxial films of metal oxides such as CuO, $Cu_2O$, AgO, ZnO, Pb—Tl—O, and iron oxides such as $Fe_3O_4$ on various metals, such as gold, platinum, copper which may be single crystal, textured or polycrystalline, and on ceramic and semiconductor surfaces, such as single crystal silicon. Polycrystalline materials include sputtered or evaporated films of metals such as gold or platinum, on substrates such as foils or plastics. See, e.g., results reported by the J. A. Switzer group in *Science,* 284, 293 (1999); *Chem. Mater.,* 11, 2289 (1999); *Chem. Mater.,* 13, 508 (2001); *Chem. Mater.,* 14, 2750 (2002); *J. Amer. Chem. Soc.,* 124, 7604 (2002); *J. Phys. Chem. B,* 106, 12369 (2002). The deposition solution and applied potential can have a profound effect on the crystallographic orientation and morphology of the epitaxial films. For example, films of electrodeposited $Cu_2O$ have a crystallographic orientation that is pH dependent. A film of $Cu_2O$ deposited on Au(001) at pH 12 undergoes a transition from a thermodynamically-controlled orientation to a kinetically-controlled orientation after reaching a critical thickness. See, J. A. Switzer et al., *J. Phys. Chem. B,* 106, 4027 (2002). Other useful metal oxides can include $Co_3O_4$, $MnO_2$ and $Mn_3O_4$.

EXAMPLE 1

Deposition of CuO Films on Au(001)

The CuO films in this study were deposited using the general method of P. Poizot et al., *Electrochemical and Solid State Letters,* 6, C21-C25 (2003). The CuO films were deposited to a thickness of about 300 nm at 30° C. onto a polished and $H_2$-flame-annealed Au(001) single crystal at an anodic current density of 1 mA/cm$^2$ from an aqueous solution of 0.2 M Cu(II), 0.2 M tartrate ion, and 3 M NaOH. The electrodeposited CuO has a monoclinic structure (space group=C2/c) with a=0.4685 nm, b=0.3430 nm, c=0.5139 nm, and $\beta$=99.08°.

X-ray diffraction measurements were done on a high-resolution Philips X'Pert MRD diffractometer. For the Bragg-Brentano scan the primary optics module was a combination Gobel mirror and a 2-crystal Ge(220) 2-bounce hybrid monochromator, and the secondary optics module was a 0.18° parallel plate collimator. The hybrid monochromator produces pure CuK$\alpha_1$ radiation ($\lambda$=0.1540562 nm) with a divergence of 25 arcseconds. Pole figures were obtained in point-focus mode using a crossed-slit collimator as the primary optics and a flat graphite monochromator as the secondary optics. A 2$\theta$ value of 38.742° was used to probe the (111) reflection of CuO. Enantiomeric excesses were determined from CuO(111) azimuthal scans at $2\theta$=38.742° and $\chi$=63° by integrating the area under the (111) and ($\bar{1}\ \bar{1}\ \bar{1}$) peaks due to the R and S forms of CuO, respectively.

A Bragg-Brentano X-ray diffraction pattern is shown in FIG. 1 for an epitaxial film of CuO on Au(001) that was electrodeposited from a solution of Cu(II)(R,R)-tartrate. The film has a strong [1 $\bar{1}$ $\bar{1}$] orientation, indicating that the system has a CuO(1 $\bar{1}$ $\bar{1}$)//Au(001) epitaxial relationship. This is similar to the result obtained by other workers for the vapor deposition of CuO on MgO. In that case the film grew with a [111] orientation on MgO(001). See A. Catana et al., *Phys. Rev. B,* 46, 15477 (1992) and I. M. Watson et al., *Thin Solid Films,* 251, 51 (1994). The orientation of electrodeposited CuO can be changed to [1 $\bar{1}$ 1] by depositing the film from a solution of Cu(II)(S,S)-tartrate. The [1 $\bar{1}$ $\bar{1}$] and [$\bar{1}$ 1 1]orientations are not distinguishable by Bragg-Brentano scans, because the d-spacings for the two orientations are identical.

EXAMPLE 2

Determination of Absolute Configuration of Deposited Films

Figure 2:
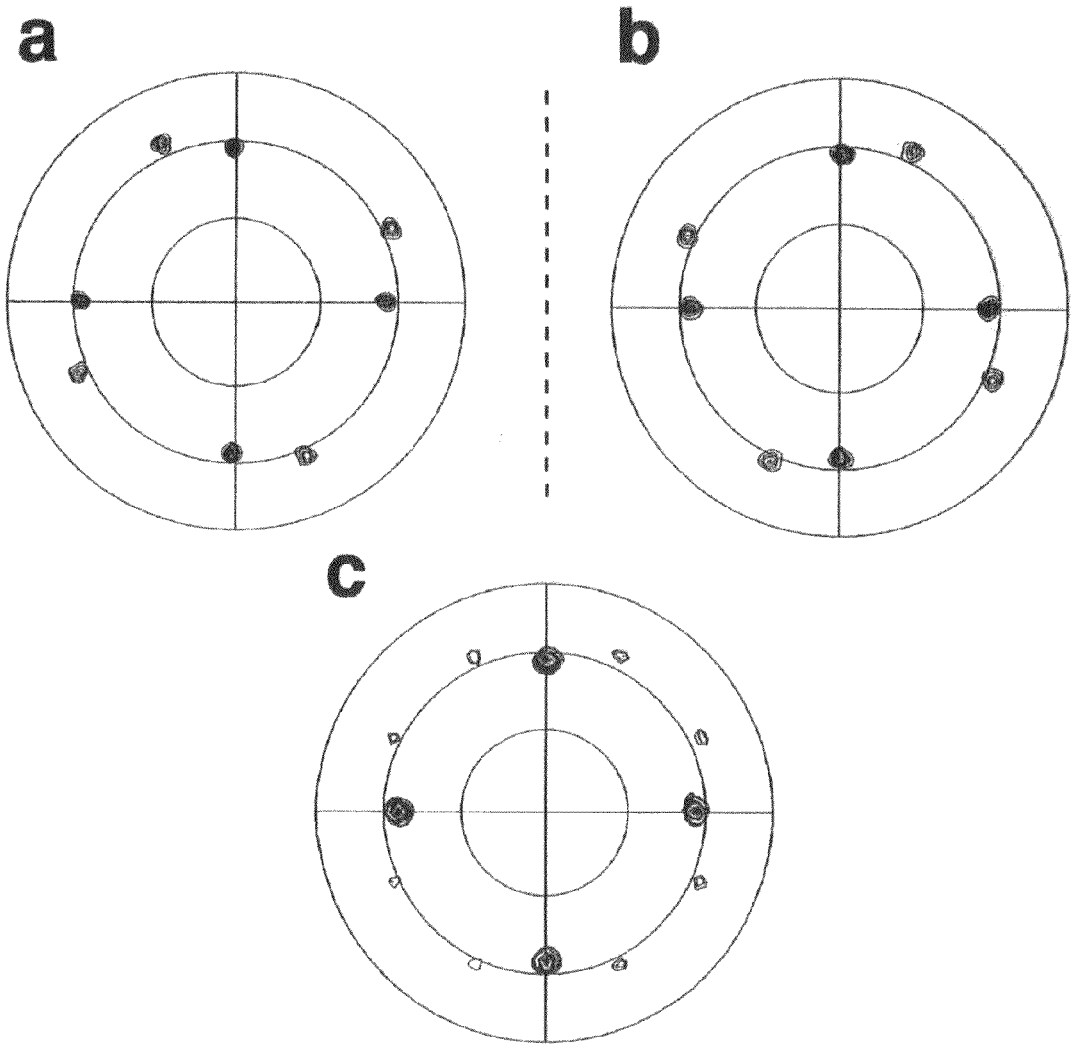
FIG. 2 depicts the x-ray pole figures of CuO films on Au(001) deposited from (A) Cu(II)(R,R-tartrate) and (B) Cu(II)(S,S-tartrate) and (C) racemic Cu(II) tartrate. The film grown in Cu(II)(R,R-tartrate) has a [1 $\bar{1}$ $\bar{1}$] orientation, and the film grown in Cu(II)(S,S-tartrate) has a [$\bar{1}$ 1 1] orientation. The two films are enantiomorphs. The film in (A) has an S configuration, and the film in (B) has an R configuration. The film in (C) deposited from the racemic mixture shows equal amounts of R and S configurations. The radial grid lines on the pole figures correspond to 30° increments of the tilt angle.

The absolute configuration of the electrodeposited films was determined by X-ray pole figure analysis. Pole figures can be used to probe planes which are not parallel with the geometric surface of the sample. The sample is moved through a series of tilt angles, $\chi$, and at each tilt angle the sample is rotated through azimuthal angles, $\Phi$, of 0 to 360°. Peaks occur in the pole figure when the Bragg condition is satisfied. Pole figures are shown in FIG. 2*a* and 2*b* for CuO films that were deposited from (R,R) and (S,S)-tartrate solutions, respectively. The (111) planes of CuO were probed because they are close in d-spacing to those of Au(111). Therefore, there are four peaks at $\chi$=55° which result from the Au. These serve as an internal reference point for the CuO peaks. Overlapping with the four Au peaks are peaks due to CuO(1 $\bar{1}$ 1) in FIG. 2*a* and CuO($\bar{1}$ 1 $\bar{1}$) in FIG. 2*b*. There are also four peaks at $\chi$=63° which correspond to CuO($\bar{1}$ $\bar{1}$ $\bar{1}$) in FIG. 2*a* and CuO(111 in FIG. 2*b*. By comparison with stereographic projections for the monoclinic structure, these can be assigned as a [1 $\bar{1}$ $\bar{1}$] orientation for the film grown in (R,R)-tartrate (FIG. 2*a*), and a [$\bar{1}$ 1 1] orientation for the film grown in (S,S)-tartrate (FIG. 2*b*). In each case there are four equivalent in-plane orientations, with the [110] direction of CuO coincident with the [110], [1 $\bar{1}$ 0], [$\bar{1}$ 1 0], and [$\bar{1}$ $\bar{1}$ 0] two pole figures in FIGS. 2*a* and 2*b* are nonsuperimposable mirror images, indicating that the two films are enantiomers.

Figure 3:
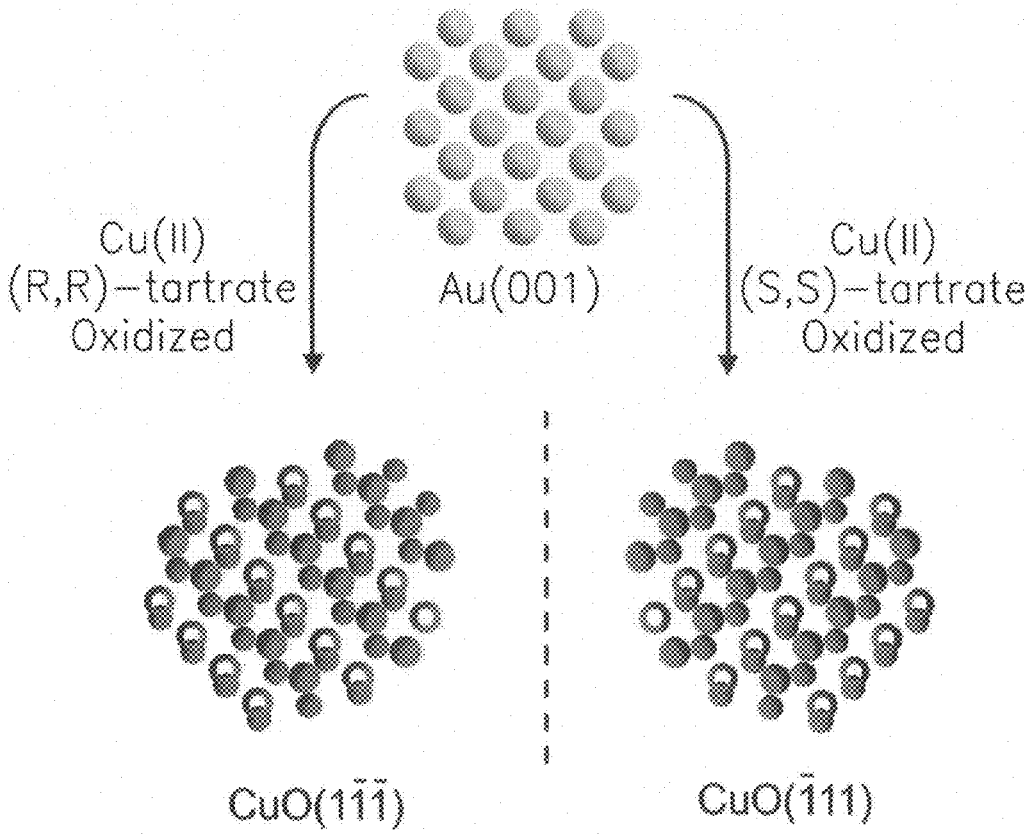
FIG. 3 outlines the chiral electrodeposition scheme and the resulting surfaces. Chiral CuO is electrodeposited onto achiral Au(001). The dark red spheres at the bottom of the figure represent Cu atoms. There are two non equivalent O atoms which are colored blue. The solid, blue colored O atoms are closest to the Cu plane, and sit in three-fold hollow sites. The hollow, blue O atoms are nearly atop the Cu atoms. The two orientations of CuO are clearly nonsuperimposable mirror images.

The chiral deposition scheme is outlined in FIG. 3. The surfaces shown are ideal terminations of the bulk structure. In this figure, the smaller Cu atoms are dark red, and there are two distinct oxygen atoms. The solid blue-colored oxygen atoms are closest to the Cu plane, and sit in three-fold hollow sites. The hollow, blue-colored oxygen atoms are situated nearly atop the Cu atoms. The [1 $\bar{1}$ $\bar{1}$] and [$\bar{1}$ 1 1] orientations of CuO shown in the figure are nonsuperimposable mirror images. Although CuO has an achiral space group, the [1 $\bar{1}$ $\bar{1}$] and [$\bar{1}$ 1 1] faces are enantromorphs because they lack a center of symmetry.

The handedness of the CuO films is determined by the chirality of the deposition solution, because the Au(001) surface has high symmetry and does not impart the chirality. This chiral electrodeposition can be attributed to the adsorption of either free tartrate ions or Cu(II)(tartrate) complexes on the Au surface. The modified surface induces chiral electrodeposition of the CuO epitaxial films. Complexes of Cu(II)(tartrate) have a dimeric structure with a symmetry that is determined by the handedness of the tartrate ligands (R. J. Missavage et al, *J. Coord. Chem.,* 2, 145 (1975)). M. O. Lorenzo et al., *Nature,* 404, 376 (2000) have shown that tartrate can adsorb onto Cu(110) to form chiral surfaces.

Using the method of G. A. Attard et al., *J. Phys. Chem. B.* 103, 1381 (1999), an R or S designation can be assigned to the two enantiomorphs. By analogy to the Cahn-Ingold-Prelog sequence rules for organic molecules, an arbitrary "priority" is assigned to each of the low index planes of a crystal based on the surface packing density. For fcc metals this sequence is {111}>{100}>{110}. If the {111}→{100}→{110} sequence runs clockwise in the stereographic projection of the material along a particular zone axis, the orientation is designated "R." Counter clockwise rotation yields the designation "S." Although this notation is arbitrary, it does allow one to assign a label to each of the enantiomers; the R-enantiomer of CuO deposits with an 85% enantiomeric excess from the (S,S) tartrate solution, and the S-enantiomer deposits with a 90% enantiomeric excess from the (R,R)-tartrate solution.

EXAMPLE 3

Electrochemical Oxidation of Tartrate

Figure 4:
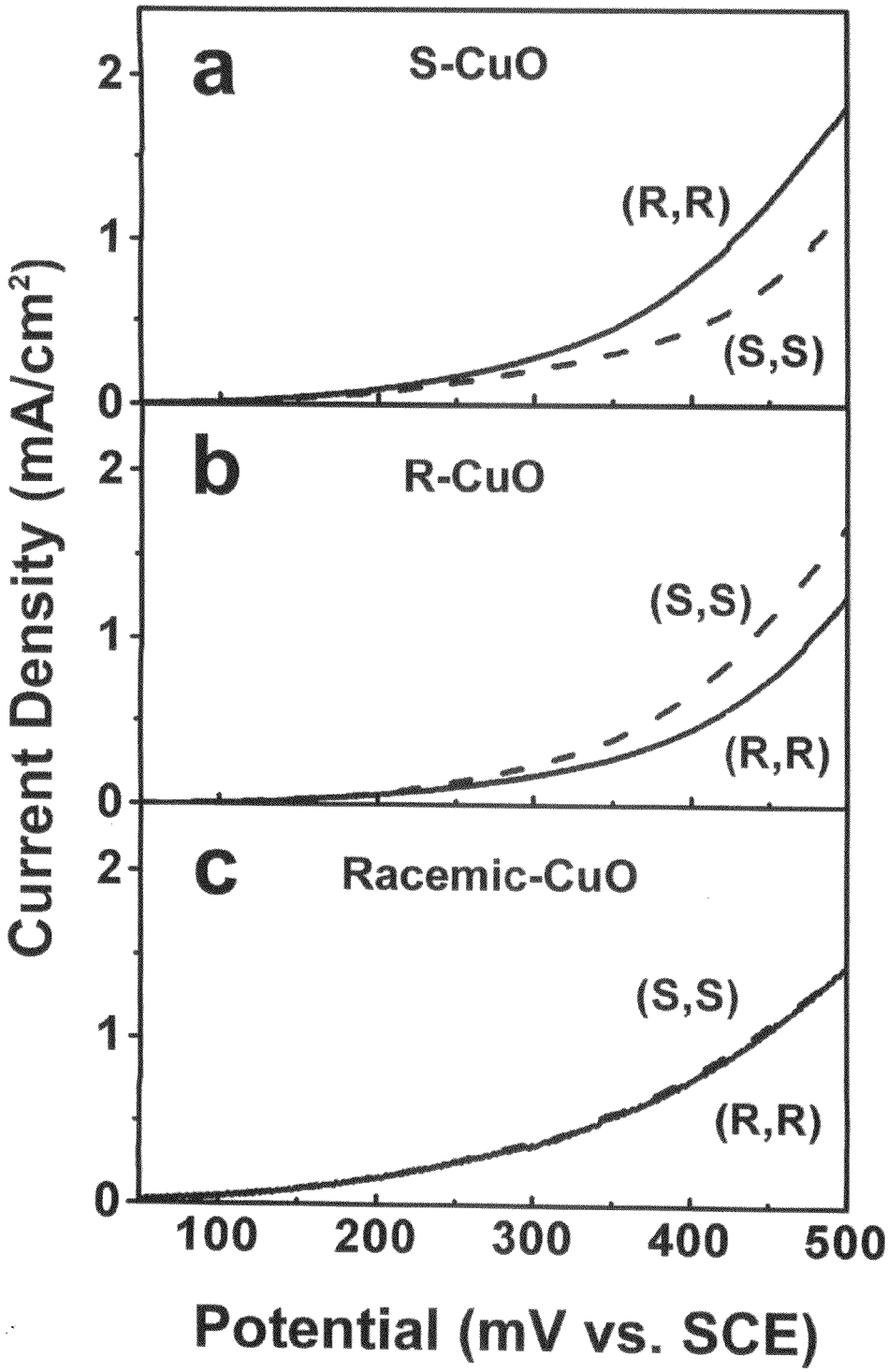
FIG. 4 depicts linear sweep voltammograms comparing the electrocatalytic activity of (A) an S—CuO film grown in Cu(II)(R,R-tartrate) with that of (B) an R—CuO film grown in Cu(II)(S,S-tartrate) for the oxidation of tartrate. The S—CuO(1 $\bar{1}$ $\bar{1}$) film is enantioselective for the oxidation of (R,R)-tartrate, and the R—CuO($\bar{1}$ 1 1) film is enantioselective for the oxidation of (S,S)-tartrate. A control film deposited from racemic Cu(II)(tartrate) shown on (C) has no enantioselectivity. The voltammograms were run at room temperature at a sweep rate of 10 mV/s in a stirred solution of 5 mM (R,R) and (S,S)-tartrate in 0.1 M NaOH.

The pole figures show that the films grown in (S,S) and (R,R)-tartrate are enantiomers, but they do not provide information on the chirality of the surface. In order to probe the surface chirality, the electrochemical activity for films deposited in the two solutions was compared for the electrochemical oxidation of (R,R) and (S,S)-tartrate. CuO has been shown by other workers to be a potent electrocatalyst for the oxidation of carbohydrates, amino acids, simple alcohols, aliphatic diols, and alkyl polyethoxy alcohol detergents. See, e.g., K. Kano et al., *J. Electroanal. Chem.,* 372, (1994) and Y. Xie et al., *Anal. Chem.,* 63, 1714 (1991). Chiral recognition by CuO has not been demonstrated previously. Linear sweep voltammograms are shown in FIG. 4 for the oxidation of (R,R) and (S,S)-tartrate on CuO electrodes which were deposited from Cu(II)(R,R)-tartrate (FIG. 4*a*) and Cu(II)(S,S)-tartrate (FIG. 4*b*). The linear sweep voltammograms in FIG. 4 were run at room temperature in stirred solutions of 5 mM (R,R) and (S,S)-tartrate in 0.1 M NaOH at a sweep rate of 10 mV/s. The S—CuO film grown in (R,R)-tartrate is more active for the oxidation of the (R,R)-tartrate, and the R—CuO film grown in (S,S)-tartrate is more active for the oxidation of the (S,S)-tartrate. A control film shown in FIG. 4*c* that was deposited from a racemic mixture of the (R,R)- and (S,S)-tartrates shows no selectivity for the oxidation of the enantiomers.

EXAMPLE 4

Enantiomorphic CuO Films Grown on Polycrystalline Gold

Following the procedures of Example 1, CuO films were grown on polycrystalline gold using both Cu(II) tartrate enantiomers and a racemic mixture.

Figure 5:
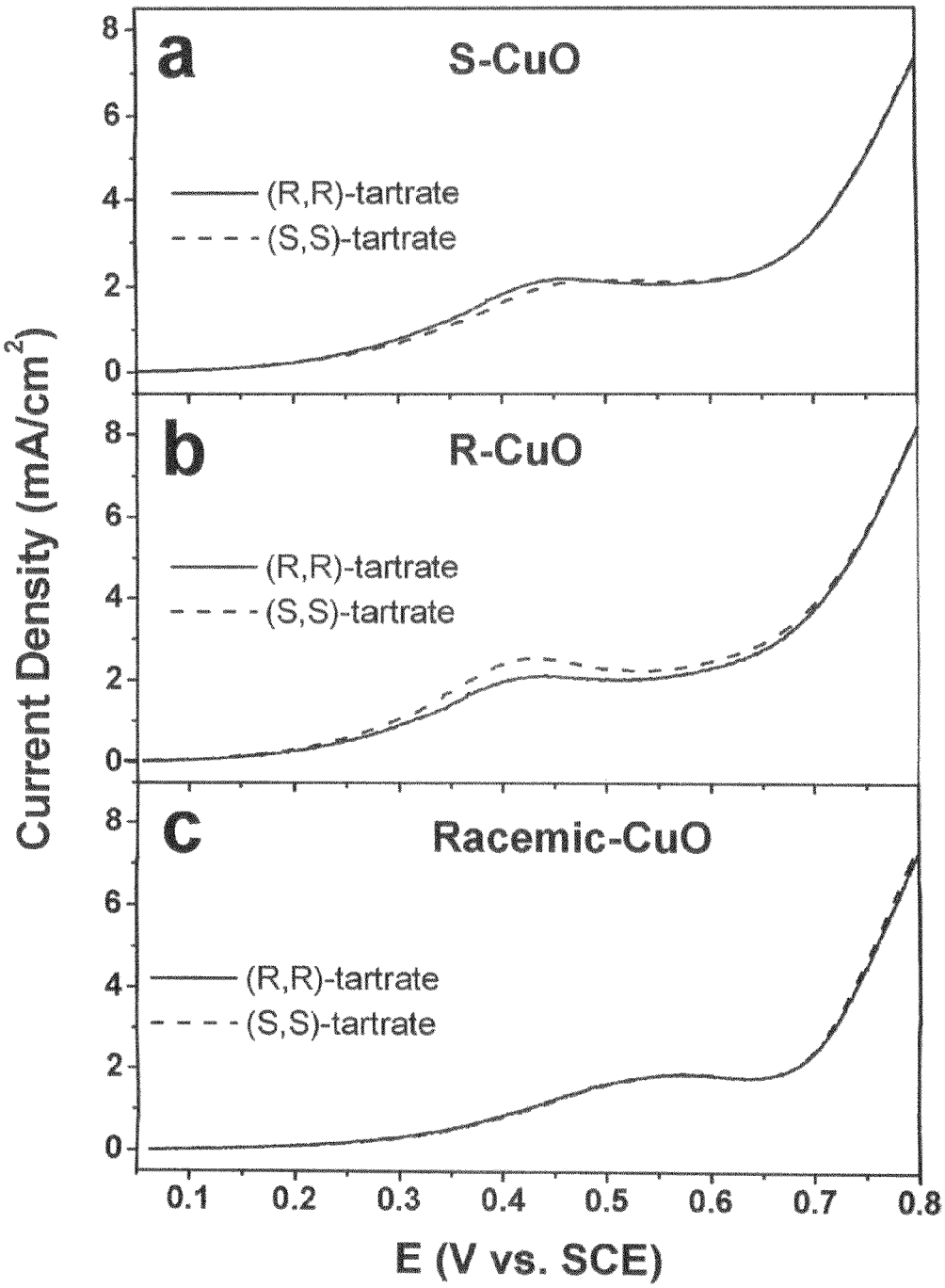
FIG. 5 depicts a linear sweep voltammograms comparing the electrocatalytic activity of a CuO film grown in S,S—, R,R— and racemic copper tartrate solutions on oxidation of tartrate on a polycrystalline Au substrate.

Linear sweep voltammograms comparing the electrocatalytic activity of a CuO film grown in (a) Cu(II)(R,R-tartrate), (b) Cu(II)(S,S-tartrate), and (c) Cu(II)(racemic-tartrate) for the oxidation of tartrate on a polycrystalline Au substrate are depicted in FIG. 5. The CuO films grown in Cu(II)(R,R-tartrate) and Cu(II)(S,S-tartrate) are enantioselective for the oxidation of (R,R)-tartrate and (S,S)-tartrate, respectively. A control film deposited from racemic Cu(II)(tartrate) shown in (c) has no enantiospecificity. The voltammograms were run at room temperature at a sweep rate of 10 mV/s in an unstirred solution of uncomplexed 5 mM (R,R) and (S,S)-tartrate in 0.1 M NaOH. The area of the polycrystalline gold electrode was 0.13 $cm^2$. The (R,R)-tartrate and (S,S)-tartrate voltammograms are designated with solid and dashed lines, respectively.

EXAMPLE 5

Enantiospecific Electrodeposition of Chiral CuO Films on Single-Crystal Cu(111)

Figure 6:
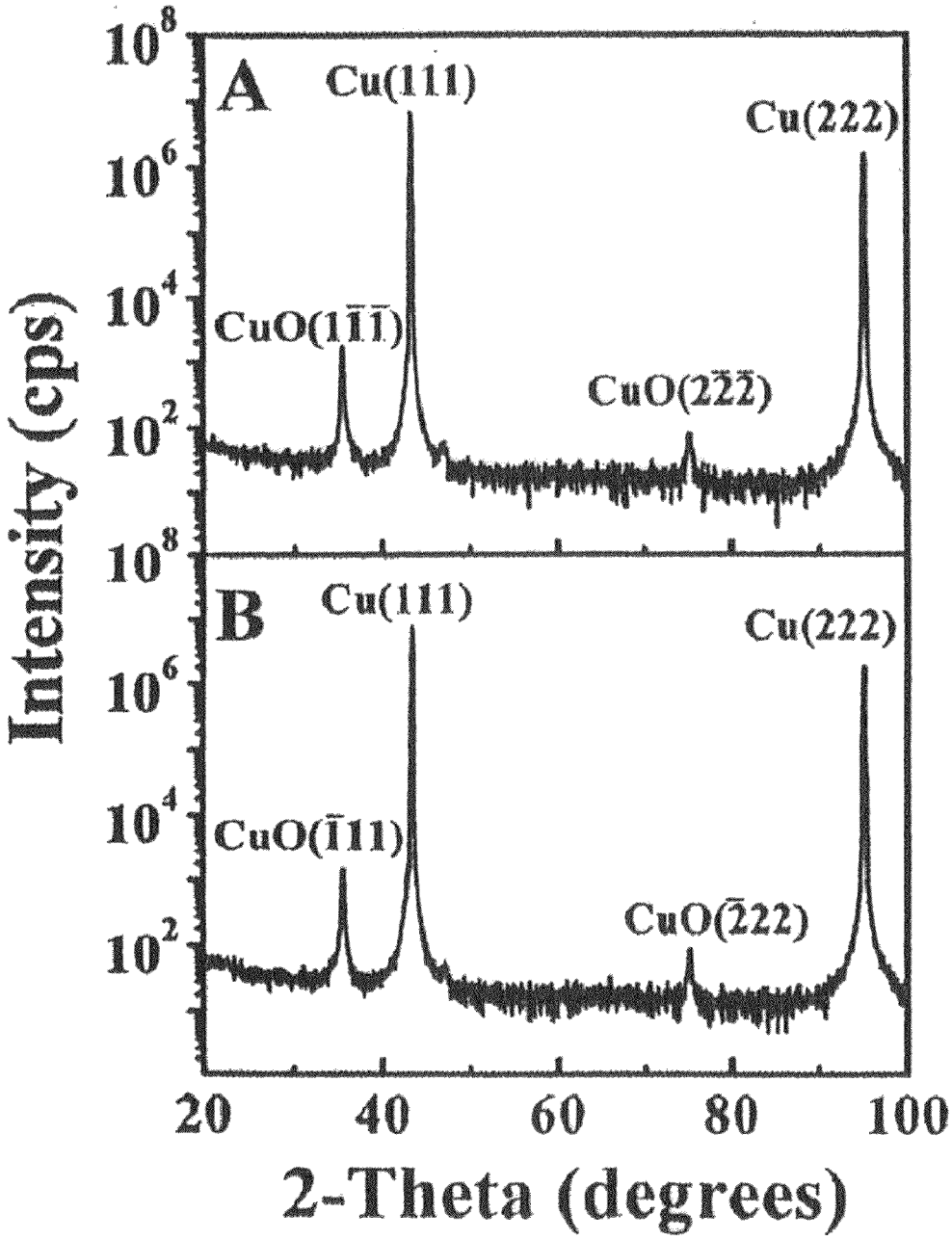
FIG. 6 depicts Bragg-Brentano scans of CuO films on Cu(111) single crystals. The film in (A) was electrodeposited from a solution of Cu(II) (R,R)-tartrate while the film in (B) was deposited from a solution of Cu(II) (S,S)-tartrate.

Two CuO films were electrodeposited at 0.4 V vs. SCE for 45 minutes on a Cu(111) single crystal from a solution of 0.2 M Cu(II), 0.2 M tartrate ion in 3M NaOH at 30° C. The anodic charge density was 8 $C/cm^2$, and the films were 400 nm thick. FIG. 6A shows the Bragg-Brentano x-ray diffraction pattern for the film deposited from Cu(II) (R,R)-tartrate and FIG. 6B shows the pattern for the film deposited from Cu(II) (S,S)-tartrate. From the Bragg-Brentano patterns it appears that there is no difference between the two highly textured films. However, analysis of pole figures obtained from the epitaxial films demonstrates that the films actually have two different orientations, CuO(1 $\bar{1}$ $\bar{1}$) in FIG. 6A and CuO($\bar{1}$ 1 1) in FIG. 6B.

Figure 7A:
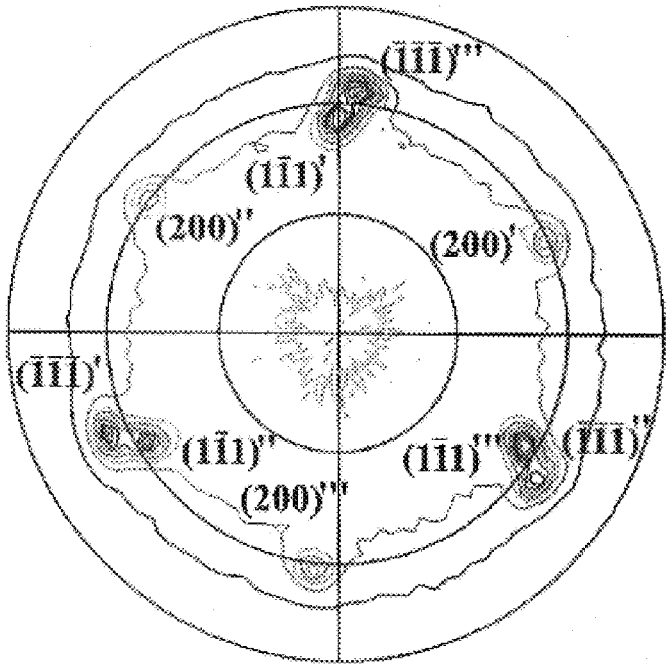
FIG. 7 depicts CuO(111) pole figures of a film electrodeposited from solutions of Cu(II) (R,R)-tartrate (A) and Cu(II) (S,S)-tartrate (B). The (111) and (200) CuO planes have similar d-spacings and are both observed in the pole figure.
Figure 7B:
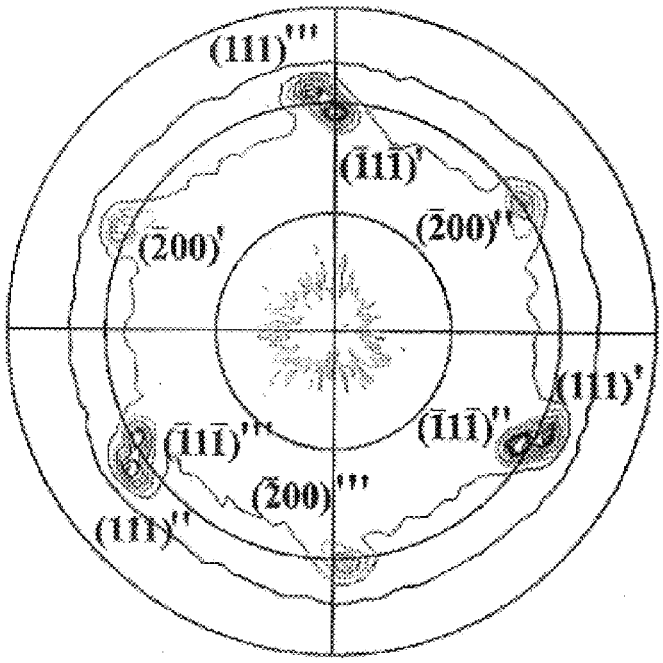

Epitaxial electrodeposition has been demonstrated for a number of oxides on single crystal metal and semiconductor substrates. See, e.g., Th. Pauporte et al., *Appl. Phys. Lett,* 75, 3817 (1999); Th. Pauporte et al., *Chem. Mater.,* 14, 4702 (2002); J. A. Switzer et al., *J. Phys. Chem. B.,* 106, 12369 (2002). Because the CuO in the present work was deposited onto single-crystal Cu(111) the absolute configuration of the film can be determined by x-ray pole figure analysis. By choosing a specific d-spacing to probe while measuring diffracted intensity as a function of tilt and rotation, a pole figure is obtained. FIG. 7A shows the CuO (111) pole figure for the CuO film deposited from Cu(II) (R,R)-tartrate while FIG. 7B shows the same pole figure for the CuO film deposited from Cu(II) (S,S)-tartrate. The two pole figures are clearly non-superimposible mirror images of one another. Further analysis reveals that each pole figure is a result of three crystalline domains rotated 120 degrees from one another. Although the d-spacing for the CuO(111) planes was probed for the pole figures in FIG. 7, diffraction from the CuO(200) planes is also observed as the two d-spacings are not sufficiently resolved from one another. The film examined in FIG. 7A is consistent only with a CuO(1 $\bar{1}$ $\bar{1}$) out of plane orientation while the film in FIG. 7B has a CuO($\bar{1}$ 1 1) out of plane orientation. Although not shown due to space limitations, CuO films deposited from Cu(II) complexed with racemic tartrate show equal amounts of the CuO(1 $\bar{1}$ $\bar{1}$) and CuO($\bar{1}$ 1 1) orientations.

Figure 8:
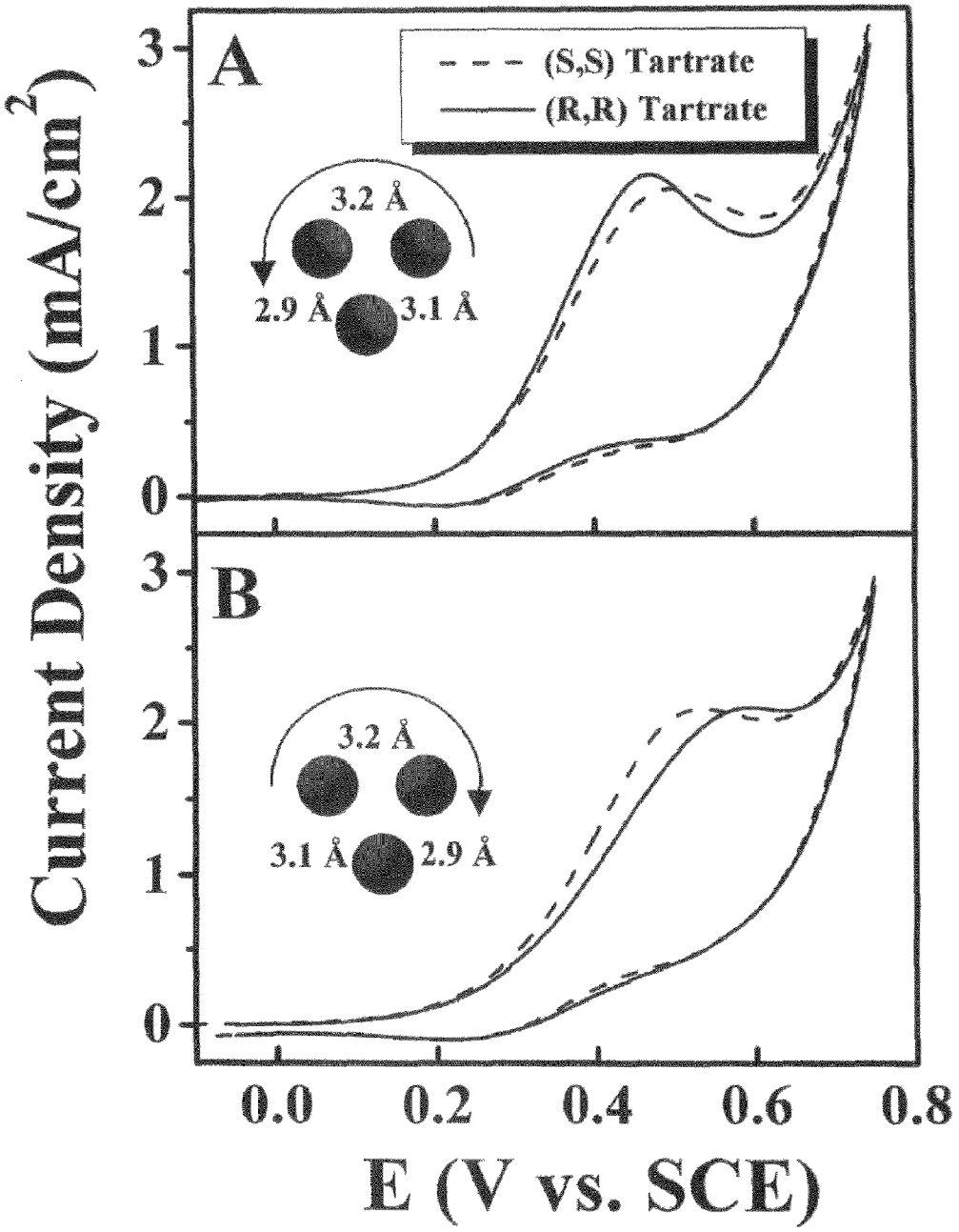
FIG. 8 depicts cyclic voltammograms obtained at a scan rate of 10 mV/s from 5 mM solutions of (S,S)- and (R,R)-tartrate in 0.1 m NaOH on (A) a CuO(1 $\bar{1}$ $\bar{1}$) working electrode and (B) a CuO($\bar{1}$ 1 1) working electrode. The CuO(1 $\bar{1}$ $\bar{1}$) surface is seen to be more active toward the oxidation of (R,R)-tartrate while the CuO($\bar{1}$ 1 1) surface is seen to be more active toward the oxidation of (S,S)-tartrate. The inset in (A) shows the arrangement of Cu atoms on the (1 $\bar{1}$ $\bar{1}$) plane and the counter-clockwise rotation observed when assigning priority to increasing distances between the Cu atoms. The inset in (B) shows the same, except on the ($\bar{1}$ 1 1) surface. In this instance a clockwise rotation is obtained.

FIG. 8A shows cyclic voltammograms obtained on a CuO(1 $\bar{1}$ $\bar{1}$) film in 5 mM solutions of (S,S)- and (R,R)-tartrate in 0.1 M NaOH, while FIG. 8B shows the same for a CuO($\bar{1}$ 1 1) film on Cu(1 1 1). The electrodeposited CuO acts as a catalyst toward the oxidation of tartrate as well as exhibiting enantioselectivity toward the different chiral forms of the ion. Examination of FIG. 8A reveals that the CuO(1 $\bar{1}$ $\bar{1}$) film more readily oxidizes (R,R)-tartrate while the CuO($\bar{1}$ 1 1) film more readily oxidizes the (S,S)-tartrate as seen in FIG. 8B. Although not shown due to space considerations, CuO films deposited from the racemic Cu(II) tartrate show identical voltammograms in the (R,R)- and (S,S)-tartrate solutions.

The enantioselective adsorption of tartrate or that of the Cu(II) tartrate complex itself on single-crystal Cu is almost certainly related to the enantioselective electrodeposition observed here. Although the exact mechanism of enantioselectivity observed with cyclic voltammetry is under investigation, one can see how it may arise by examining the arrangement of Cu atoms on the (1 $\bar{1}$ $\bar{1}$) and ($\bar{1}$ 1 1) CuO planes. The Cu atoms on the CuO(1 $\bar{1}$ $\bar{1}$) plane have a pseudo-hexagonal arrangement with three slightly different spacings between the copper atoms. If a rotation is arbitrarily assigned based on increasing spacing between the Cu atoms we obtain a counter-clockwise rotation as seen in the inset in FIG. 8A. Applying the same set of rules a clockwise rotation is obtained for the Cu atoms on the CuO ($\bar{1}$ 1 1) plane as seen on the inset in FIG. 8B. The arrangement of Cu atoms on the two planes lack a center of symmetry and they are nonsuperimposible mirror images of one another. The tartrate ions may not necessarily be interacting with Cu atoms on the ($\bar{1}$ 1 1) and (1 $\bar{1}$ $\bar{1}$) planes, but one can reasonably assume that the "true" surface of interaction would contain some manifestation of this two-dimensional chirality.

The present invention thus is exemplified by a method for the electrodeposition of chiral films of CuO onto achiral Au(001) or single crystal Cu(111) surfaces using chiral molecules to direct the enantiospecific deposition. The present examples use a single crystal substrate, so that the absolute configuration can be obtained by X-ray diffraction. For practical applications, inexpensive polycrystalline or textured substrates will be employed, such as rolling-assisted biaxially textured substrates (RABiTS®). These single-crystal-like tapes are available at a relatively low cost for a variety of metals, including copper, and can be used as a cost-effective substrate for enantiospecific electrodeposition. See, e.g., D. P. Norton et al., *Science,* 274, 755 (1996).

The present chiral electrodeposition method can be generally used for the deposition of other chiral catalysts, and for the synthesis and sensing of other chiral molecules. Post-chromatographic chiral electrochemical sensors can obviate the need for chiral separations prior to chemical detection.

Electrodeposition also affords the ability to control the morphology and orientation of the films by varying solution conditions, which can be useful in designing these chiral surfaces. See, J. A. Switzer et al., *J. Phys. Chem. B.,* 106 4027 (2002).

All publications, patents and patent applications referred to herein are incorporated herein by reference. While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A method for preparing a chiral substrate surface comprising electrodeposition of a chiral metal oxide array from a solution of a chiral salt of said metal onto an achiral array of atoms of high symmetry on said surface.

2. The method of claim 1 wherein an epitaxial film of metal oxide is deposited on the surface.

3. The method of claim 1 or 2 wherein the chiral metal oxide array comprises CuO, $Cu_2O$, $Co_3O_4$, $MnO_3$, AgO, ZnO, Pb—Tl—O or an iron oxide.

4. The method of claim 1 wherein the achiral array of atoms comprises metal atoms or silicon atoms.

5. The method of claim 4 wherein the silicon atoms are present as $SiO_2$.

6. The method of claim 4 wherein the metal atoms are gold, platinum or copper atoms.

7. The method of claim 4 wherein the chiral array is on a rolling-assisted biaxially textured substrate.

* * * * *

UNITED STATES PATENT AND TRADEMARK OFFICE

CERTIFICATE OF CORRECTION

PATENT NO. : 7,361,261 B2
APPLICATION NO. : 10/884868
DATED : April 22, 2008
INVENTOR(S) : Switzer et al.

It is certified that error appears in the above-identified patent and that said Letters Patent is hereby corrected as shown below:

On the Title page, in field (56), under "Other Publications", in column 2, line 3, delete "(l)" and insert -- (I) --, therefor.

On the Title page, in field (57), under "Abstract", in column 2, line 11, delete "of(R,R)" and insert -- of (R,R) --, therefor.

Title page 2, in field (56), under "Other Publications", in column 2, line 1, delete "Pb-TI-O" and insert -- Pb-Tl-O --, therefor.

In column 1, line 40, after "Nature" insert -- , --.

In column 5, line 14, delete "[1 $\bar{1}$ 1]" and insert -- [$\bar{1}$ 1 1] --, therefor.

In column 5, line 41, after "CuO(111" insert -- ) --.

In column 5, line 48, after "[$\bar{1}$ $\bar{1}$ 0]" insert -- directions of Au. The --.

In column 6, line 4, delete "et al," and insert -- et al., --, therefor.

In column 8, line 48, after "106" insert -- , --.

Signed and Sealed this

Ninth Day of December, 2008

JON W. DUDAS
*Director of the United States Patent and Trademark Office*